US005994290A

United States Patent [19]

Potthoff-Karl et al.

[11] Patent Number: 5,994,290

[45] Date of Patent: Nov. 30, 1999

[54] SOLID TEXTILE DETERGENT FORMULATION COMPRISING INORGANIC BUILDERS, GLYCINE-N'N-DIACETIC ACID DERIVATIVES AS ORGANIC COBUILDERS AND ANIONIC AND NONIONIC SURFACTANTS

[75] Inventors: Birgit Potthoff-Karl; Beate Ehle, both of Ludwigshafen; Angelika Funhoff, Mannheim; Dieter Kiessling, Bad Dürkheim; Richard Baur, Mutterstadt; Thomas Greindl, Neuburg, all of Germany

[73] Assignee: BASF Aktiengesellschaft, Ludwigshafen, Germany

[21] Appl. No.: 09/068,552

[22] PCT Filed: Nov. 5, 1996

[86] PCT No.: PCT/EP96/04817

§ 371 Date: May 18, 1998

§ 102(e) Date: May 18, 1998

[87] PCT Pub. No.: WO97/19159

PCT Pub. Date: May 29, 1997

[30] Foreign Application Priority Data

Nov. 18, 1995 [DE] Germany ..... 195 43 162

[51] Int. Cl.[6] ..... C11D 3/10; C11D 3/08; C11D 3/33

[52] U.S. Cl. ..... 510/531; 510/532; 510/533; 510/480; 510/302; 510/305; 510/367; 510/372; 510/377; 510/374; 510/392; 510/398; 510/434; 510/507; 510/509; 510/276; 510/300; 510/310; 510/315; 510/318; 510/323; 510/340; 510/361; 510/443

[58] Field of Search ..... 510/276, 289, 510/290, 300, 310, 315, 316, 318, 323, 533, 340, 356, 357, 361, 443, 445, 446, 531, 532, 480, 302, 305, 367, 372, 377, 374, 392, 398, 434, 507, 509

[56] References Cited

U.S. PATENT DOCUMENTS

| | | | |
|---|---|---|---|
| 3,849,327 | 11/1974 | DiSalvo et al. | 252/109 |
| 4,196,093 | 4/1980 | Clarke et al. | 252/99 |
| 4,997,587 | 3/1991 | Baur et al. | 252/102 |
| 5,362,412 | 11/1994 | Hartman et al. | 252/94 |
| 5,719,111 | 2/1998 | Van Den Brom et al. | 510/224 |
| 5,750,483 | 5/1998 | Welch et al. | 510/230 |
| 5,759,978 | 6/1998 | Welch et al. | 510/230 |

FOREIGN PATENT DOCUMENTS

| | | |
|---|---|---|
| 2162122 | 12/1994 | Canada . |
| 0 463 801 | 1/1992 | European Pat. Off. . |
| 33 40 164 | 5/1985 | Germany . |
| 43 19 935 | 12/1994 | Germany . |
| 55-157695 | 12/1980 | Japan . |

OTHER PUBLICATIONS

Database WPI Derwent Publications Ltd., London, GB; Class D 25, AN 94–156882 JP 06 100 884, Apr. 12, 1994.

Database WPI Derwent Publications Ltd., London GB; Class D 25, AN 81–12519D JP 55 160 099, Dec. 13, 1980.

*Primary Examiner*—Yogendra Gupta
*Assistant Examiner*—Charles Boyer
*Attorney, Agent, or Firm*—Oblon, Spivak, McClelland, Maier & Neustadt, P.C.

[57] ABSTRACT

A solid textile detergent formulation, comprising (A) 1–60% by weight of inorganic builders based on crystalline or amorphous aluminosilicates, crystalline or amorphous silicates, carbonates and/or phosphates, (B) 0.1–25% by weight of one or more glycine-N,N'-diacetic acid derivatives I (I)

where R is an organic radical and M is hydrogen or a cation, as organic cobuilders, (C) 1–40% by weight of anionic surfactants and (D) 0.5–30% by weight of nonionic surfactants.

7 Claims, No Drawings

SOLID TEXTILE DETERGENT FORMULATION COMPRISING INORGANIC BUILDERS, GLYCINE-N' N-DIACETIC ACID DERIVATIVES AS ORGANIC COBUILDERS AND ANIONIC AND NONIONIC SURFACTANTS

This application is a 371 of PCT/EP96/04817 filed Nov. 5, 1996.

BACKGROUND OF THE INVENTION

1. Field of the Invention

The present invention relates to a solid textile detergent formulation comprising inorganic builders based on silicates, aluminosilicates, carbonates and/or phosphates, glycine-N,N-diacetic acid derivatives as organic cobuilders and anionic and nonionic surfactants.

2. Description of the Related Art

Conventional powder detergents for textiles comprise large amounts of builders which are of low solubility or are insoluble, such as zeolites or silicates, which are needed to achieve a high single wash and multi wash cycle performance. This large proportion of components which are insoluble in the wash liquor also greatly impairs the overall solubility of the detergent formulation.

It is an object of the present invention to provide a solid textile detergent formulation with improved solubility of the builder system without adverse effects, in particular on the single wash cycle performance.

WO-A 94/29421 (1) discloses the use of glycine-N,N-diacetic acid derivatives as biodegradable complexing agents for alkaline earth metal and heavy metal ions inter alia in the detergent and cleaner sector. Thus, it is mentioned therein that such glycine-N,N-diacetic acid derivatives can generally be used as complexing agents or as builder in powder detergent formulations for textile laundering.

Japanese Published Specifications 1980/157695 (2) and 1980/160099 (3) describe solid detergent compositions for textile laundering which comprise N,N-bis(carboxymethyl) amino acids such as N,N-bis(carboxymethyl)alanine, surfactants, sodium metasilicate and as further builder component imidobissulfates.

SUMMARY OF THE INVENTION

We have found that this object is achieved by a solid detergent formulation which comprises (A) 1–60% by weight of inorganic builders based on crystalline or amorphous aluminosilicates, crystalline or amorphous silicates, carbonates and/or phosphates, (B) 0.1–25% by weight of one or more glycine-N,N-diacetic acid derivatives of the general formula I (I)

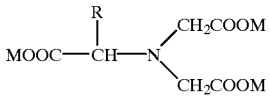

where

R is $C_1$–$C_{30}$-alkyl or $C_2$–$C_{30}$-alkenyl, each of which may additionally carry as substituents up to 5 hydroxyl groups, formyl groups, $C_1$–$C_4$-alkoxy groups, phenoxy groups or $C_1$–$C_4$-alkoxycarbonyl groups and be interrupted by up to 5 non-adjacent oxygen atoms, or alkoxylate groups of the formula $—(CH_2)_k—O-(A^1O)_m—(A^2O)_n—Y$ where $A^1$ and $A^2$ are, independently of one another, 1,2-alkylene groups having 2 to 4 carbon atoms, Y is hydrogen, $C_1$–$C_{12}$-alkyl, phenyl or $C_1$–$C_4$-alkoxycarbonyl, and k is 1, 2 or 3, and m and n are each from 0 to 50, where the total of m+n must be at least 4, or phenylalkyl groups having from 1 to 20 carbon atoms in the alkyl, a five- or six-membered unsaturated or saturated heterocyclic ring which has up to three hetero atoms from the group consisting of nitrogen, oxygen and sulfur and which can additionally be benzo-fused, it being possible for all the phenyl nuclei and heterocyclic rings mentioned in the meanings of R additionally to carry as substituents up to three $C_1$–$C_4$-alkyl groups, hydroxyl groups, carboxyl groups, sulfo groups or $C_l$–$C_4$-alkoxycarbonyl groups, or a radical of the formula

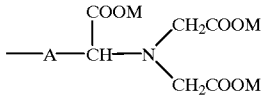

where A is a $C_l$–$C_{12}$-alkylene bridge, preferably a $C_2$–$C_{12}$-alkylene bridge, or a chemical bond, and M is hydrogen, alkali metal, alkaline earth metal, ammonium or substituted ammonium in the appropriate stoichiometric amounts, as organic cobuilders, (C) 1–40% by weight of anionic surfactants and (D) 0.5–30% by weight of nonionic surfactants.

Component (A) is preferably present in the textile detergent formulation according to the invention in an amount of from 5 to 50% by weight, in particular 10 to 45% by weight.

Suitable inorganic builders (A) are, in particular, crystalline or amorphous aluminosilicates with ion-exchanging properties such as, in particular, zeolites. Various types of zeolites are suitable, especially zeolites A, X, B, P, MAP and HS in their Na form or in forms in which Na is partly replaced by other cations such as Li, K, Ca, Mg or ammonium. Suitable zeolites are described, for example, in EP-A 038591, EP-A 021491, EP-A 087035, U.S. Pat. No. 4,604,224, GB-A 2013259, EP-A 522726, EP-A 384070 and WO-A 94/24251.

Examples of suitable crystalline silicates (A) are disilicates or sheet silicates, eg. SKS-6 (manufactured by Hoechst). The silicates can be used in the form of their alkali metal, alkaline earth metal or ammonium salts, preferably as Na, Li and Mg silicates.

Amorphous silicates such as sodium metasilicate which has a polymeric structure, or Britesil® H20 (manufactured by Akzo) can likewise be used.

Suitable inorganic carbonate-based builders are carbonates and bicarbonates. These can be used in the form of their alkali metal, alkaline earth metal or ammonium salts. Na, Li and Mg carbonates and bicarbonates, especially sodium carbonate and/or sodium bicarbonate, are preferably used.

Conventional phosphates as inorganic builders are polyphosphates such as pentasodium triphosphate.

Said components (A) can be used singly or mixed with one another. Of particular interest as inorganic builder component is a mixture of alumosilicates and carbonates, in particular of zeolites, especially zeolite A, and alkali metal carbonates, especially sodium carbonate, in the ratio of from 98:2 to 20:80, in particular from 85:15 to 40:60, by weight. It is also possible for other components (A) to be present besides this mixture.

In a preferred embodiment, the compounds I used for component (B) are those where R is $C_1$–$C_{20}$-alkyl, $C_2$–$C_{20}$-alkenyl or a radical of the formula

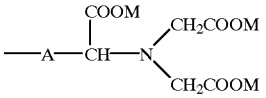

In a particularly preferred embodiment, α-alanine-N,N-diacetic acid (R=$CR_3$) and its alkali metal, ammonium and substituted ammonium salts are used as compound I.

Particularly suitable salts of this type are the sodium, potassium and ammonium salts, especially the trisodium, tripotassium and triammonium salts, and organic triamine salts with a tertiary nitrogen atom.

Particularly suitable bases underlying the organic amine salts are tertiary amines such as trialkylamines having from 1 to 6 carbon atoms in the alkyl, eg. trimethylamine and triethylamine, methyldiethylamine or tricyclohexylamine, and trialkanolamines having 2 or 3 carbon atoms in the alkanol residue, preferably triethanolamine, tri-n-propanolamine or triisopropanolamine.

The calcium and magnesium salts are particularly used as alkaline earth metal salts.

It is possible to use both the racemates of the compounds I and the two enantiomers with respect to the α-C atom in the glycine skeleton.

Besides methyl, suitable straight-chain or branched alk(en)yl radicals for R are, in particular $C_2$–$C_{17}$-alkyl and -alkenyl, and of these in particular straight-chain radicals derived from saturated or unsaturated fatty acids. Examples of individual radicals R are: ethyl, n-propyl, isopropyl, n-butyl, isobutyl, sec-butyl, tert-butyl, n-pentyl, isopentyl, tert-pentyl, neopentyl, n-hexyl, n-heptyl, 3-heptyl (derived from 2-ethylhexanoic acid), n-octyl, isooctyl (derived from isononanoic acid), n-nonyl, n-decyl, n-undecyl, n-dodecyl, isododecyl (derived from isotridecanoic acid), n-tridecyl, n-tetradecyl, n-pentadecyl, n-hexadecyl, n-heptadecyl, n-octadecyl, n-nonadecyl, n-eicosyl and n-heptadecenyl (derived from oleic acid). It is also possible for mixtures to occur for R, especially those derived from naturally occurring fatty acids and from industrial synthetic acids, for example from the oxo synthesis.

Used in particular as $C_1$–$C_{12}$-alkylene bridges A are polymethylene groups of the formula —$(CH_2)_t$— where t is from 2 to 12, in particular from 2 to 8, ie. 1,2-Ethylene, 1,3-propylene, 1,4-butylene, pentamethylene, hexamethylene, heptamethylene, octamethylene, nonamethylene, decamethylene, undecamethylene and dodecamethylene. Hexamethylene, octamethylene, 1,2-ethylene and 1,4-butylene are particularly preferred in this connection. However, it is also possible for branched $C_1$–$C_{12}$-alkylene groups to occur, eg. —$CH_2CH(CH_3)CH_2$—, —$CH_2C(CH_3)_2CH_2$—, —$CH_2CH(C_2H_5)$— or —$CH_2CH(CH_3)$—.

The $C_1$–$C_{30}$-alkyl and $C_2$–$C_{30}$-alkenyl groups may carry up to 5, in particular up to 3, additional substituents of the said type and be interrupted by up to 5, in particular up to 3, non-adjacent oxygen atoms. Examples of such substituted alk(en)yl groups are —$CH_2OH$, —$CH_2CH_2OH$, —$CH_2.CH_2$—O—$CH_3$, —$CH_2CH_2$—O—$CH_2CH_2$—O—$CH_3$, $CH_2$—O—$CH_2CH_3$, —$CH_2$—O—$CH_2CH_3$—OH, —$CH_2$—CHO, —$CH_2$—OPh, —$CH_2$—$COOCH_3$ or —$CH_2CH_2COOCH_3$.

Particularly suitable alkoxylate groups are those where m and n are each from 0 to 30, preferably from 0 to 15. $A^1$ and $A^2$ are groups derived from butylene oxide and, in particular, from propylene oxide and from ethylene oxide. Pure ethoxylates and pure propoxylates are of particular interest, but ethylene oxide/propylene oxide block structures may also occur.

Suitable five- or six-membered unsaturated or saturated heterocyclic rings which have up to three hetero atoms from the group consisting of nitrogen, oxygen and sulfur and which can additionally be benzo-fused and substituted by the designated radicals are:

tetrahydrofuran, furan, tetrahydrothiophene, thiophene, 2,5-dimethylthiophene, pyrrolidine, pyrroline, pyrrole, isoxazole, oxazole, thiazole, pyrazole, imidazoline, imidazole, 1,2,3-triazolidine, 1,2,3- and 1,2,4-triazole, 1,2,3-, 1,2,4- and 1,2,5-oxadioazole, tetrahydropyran, dihydropyran, 2 H and 4 H-pyran, piperidine, 1,3- and 1,4-dioxane, morpholine, pyrazane, pyridine, α-, β- and γ-picoline, pyrimidine, pyridazine, pyrazine, 1,2,5-oxathiazine, 1,3,5-, 1,2,3- and 1,2,4-triazine, benzofuran, thionaphthene, indoline, indole, isoindoline, benzoxazole, indazole, benzimidazole, chroman, isochroman, 2 H- and 4 H-chromene, quinoline, isoquinoline, 1,2,3,4-tetrahydroisoquinoline, cinnoline, quinazoline, quinoxaline, phthalazine and benzo-1,2,3-triazine.

N—H groups in said heterocyclic rings should where possible be in derivatized form, for example as N-alkyl groups.

When the phenyl nuclei or the heterocyclic rings are substituted there are preferably two (identical or different) or, in particular, a single substituent.

Examples of unsubstituted and substituted phenylalkyl groups and alkyl groups carrying heterocyclic rings for R are benzyl, 2-phenylethyl, 3-phenylpropyl, 4-phenylbutyl, o-, m- or p-hydroxybenzyl, o-, m- or p-carboxybenzyl, o-, m- or p-sulfobenzyl, 0-, m- or p-methoxy- or -ethoxycarbonylbenzyl, 2-furylmethyl, n-methyl-4-piperidinylmethyl or 2-, 3- or 4-pyridinylmethyl.

Substituents on the phenyl nuclei and on heterocyclic rings are preferably groups which confer solubility in water, such as hydroxyl groups, carboxyl groups or sulfo groups.

Examples of said $C_1$–$C_4$-, $C_1$–$C_{12}$- and $C_1$–$C_{20}$-alkyl groups are also to be regarded as the corresponding radicals listed above for R.

Component (B) is preferably present in the textile detergent formulation according to the invention in an amount of from 0.5 to 20% by weight, in particular 1 to 15% by weight, especially 3 to 10% by weight.

Examples of suitable anionic surf actants (C) are fatty alcohol sulfates of fatty alcohols having 8 to 22, preferably 10 to 18, carbon atoms, eg. $C_9$–$C_{11}$-alcohol sulfates, $C_{12}$–$C_{14}$-alcohol sulfates, cetyl sulfate, myristyl sulfate, palmityl sulfate, stearyl sulfate and tallow fatty alcohol sulfate.

Further suitable anionic surfactants are sulfated ethoxylated $C_8$–$C_{22}$-alcohols (alkyl ether sulfates) and their soluble salts. Compounds of this type are prepared, for example, by initially alkoxylating a $C_8$–$C_{22}$-, preferably a $C_{10}$–$C_{18}$-alcohol, eg. a fatty alcohol, and subsequently sulfating the alkoxylation product. Ethylene oxide is preferably used for the alkoxylation, in which case from 2 to 50, preferably from 3 to 20, mol of ethylene oxide are used per mol of alcohol. The alkoxylation of the alcohols can, however, also be carried out with propylene oxide alone and, where appropriate, butylene oxide. Also suitable are those alkoxylated $C_8$–$C_{22}$-alcohols which contain ethylene oxide and propylene oxide or ethylene oxide and butylene oxide or ethylene oxide and propylene oxide and butylene oxide. The alkoxylated $C_8$–$C_{22}$-alcohols can contain the ethylene oxide, propylene oxide and butylene oxide units in the form of blocks or in random distribution. Alkyl ether sulfates with a broad or narrow alkylene oxide distribution can be obtained depending on the type of alkoxylation catalyst.

Further suitable anionic surfactants are alkanesulfonates such as $C_8$–$C_{24}$-, preferably $C_{10}$–$C_{18}$-alkanesulfonates, and soaps such as the Na and K salts of $C_8$–$C_{24}$-carboxylic acids.

Further suitable anionic surfactants are linear $C_9$–$C_{20}$-alkylbenzenesulfonates (LAS) and -alkyltoluene-sulfonates.

Also suitable as anionic surfactants (C) are $C_8$–$C_{24}$-olefinsulfonates and -disulfonates which may also be mixtures of alkene- and hydroxyalkanesulfonates or -disulfonates, and alkyl ester sulfonates, sulfonated polycarboxylic acids, alkylglycerolsulfonates, fatty acid glycerol ester sulfonates, alkylphenol polyglycol ether sulfates, paraffinsulfonates with about 20 to about 50 carbon atoms (based on paraffin or paraffin mixtures obtained from natural sources), alkyl phosphates, acylisethionates, acyltaurates, acylmethyltaurates, alkylsuccinic acids, alkenylsuccinic acids or their monoesters or monoamides, alkylsulfosuccinic acids or their amides, mono- and diesters of sulfosuccinic acids, acylsarcosinates, sulfated alkyl polyglucosides, alkyl polyglycol carboxylates and hydroxyalkylsarcosinates.

The anionic surfactants are preferably added in the form of salts to the detergent. Suitable cations in these salts are alkali metal ions such as sodium, potassium and lithium, and ammonium salts such as hydroxyethylammonium, di(hydroxyethyl)ammonium and tri(hydroxyethyl) ammonium salts.

Component (C) is preferably present in the textile detergent formulation according to the invention in an amount of from 3 to 30% by weight, in particular 5 to 15% by weight. If linear $C_9$–$C_{20}$-alkylbenzenesulfonates (LAS) are also used, they are normally employed in an amount of up to 10% by weight, in particular up to 8% by weight. It is possible to use just one class of anionic surfactants alone, for example only fatty alcohol sulfates or only alkylbenzenesulfonates, but it is also possible to use mixtures of different classes, eg. a mixture of fatty alcohol sulfates and alkylbenzenesulfonates. Mixtures of different species within the individual classes of anionic surfactants can also be employed.

Examples of suitable nonionic surfactants (D) are alkoxylated $C_8$–$C_{22}$-alcohols such as fatty alcohol lkoxylates or oxo alcohol alkoxylates. The alkoxylation can be carried out with ethylene oxide, propylene oxide and/or butylene oxide. Surfactants which can be used for this purpose are all alkoxylated alcohols which have undergone addition of at least two molecules of an abovementioned alkylene oxide. Also suitable for this purpose are block copolymers of ethylene oxide, propylene oxide and/or butylene oxide, or adducts which contain said alkylene oxides in random distribution. From 2 to 50, preferably 3 to 20, mol of at least one alkylene oxide are used per mol of alcohol. Ethylene oxide is preferably used as alkylene oxide. The alcohols preferably have from 10 to 18 carbon atoms. Alkoxylates with a broad or narrow alkylene oxide distribution are obtained depending on the nature of the alkoxylation catalyst.

Another class of suitable nonionic surfactants comprises alkylphenol alkoxylates such as alkylphenol ethoxylates with $C_6$–$C_{14}$-alkyl chains and 5–30 mol of alkylene oxide units.

Another class of nonionic surfactants comprises alkyl polyglucosides with 8 to 22, preferably 10 to 18, carbon atoms in the alkyl chain. These compounds usually contain from 1 to 20, preferably 1.1 to 5, glucoside units.

Another class of nonionic surfactants comprises N-alkylglucamides with $C_6$–$C_{22}$-alkyl chains. Compounds of this type are obtained, for example, by acylation of reducing aminated sugars with appropriate long-chain carboxylic acid derivatives.

Further suitable nonionic surfactants (D) are block copolymers of ethylene oxide, propylene oxide and/or butylene oxide (Pluronic® and Tetronic® brands of BASF), polyhydroxy or polyalkoxy fatty acid derivatives such as polyhydroxy fatty acid amides, N-alkoxy or N-aryloxy polyhydroxy fatty acid amides, fatty acid amide ethoxylates, especially capped, and fatty acid alkanolamide alkoxylates.

Component (D) is preferably present in the textile detergent formulation according to the invention in an amount of from 1 to 20% by weight, in particular 3 to 12% by weight. It is possible to use just one class of nonionic surfactants alone, in particular only alkoxylated $C_8$–$C_{22}$-alcohols, but it is also possible to use mixtures of different classes. Mixtures of different species within the individual classes of nonionic surfactants can also be employed.

Since the balance between said types of surfactants is important for the effectiveness of the detergent formulation according to the invention, the ratio between anionic surfactants (C) and nonionic surfactants (D) is preferably from 95:5 to 20:80, in particular from 70:30 to 50:50, by weight.

In a preferred embodiment, the textile detergent formulation according to the invention contains in addition to component (B) from 0.5 to 20% by weight, in particular 1 to 12% by weight, of other organic cobuilders (E) in the form of low molecular weight, oligomeric or polymeric carboxylic acids, especially polycarboxylic acids, or phosphonic acids or their salts, especially Na or K salts.

Examples of suitable low molecular weight carboxylic acids or phosphonic acids for (E) are:

$C_4$–$C_{20}$-di-, -tri- and -tetracarboxylic acids such as succinic acid, propanetricarboxylic acid, butanetetracarboxylic acid, cyclopentanetetracarboxylic acid and alkyl- and alkenylsuccinic acids with $C_2$–$C_{16}$-alkyl and -alkenyl radicals;

$C_4$–$C_{20}$-hydroxy carboxylic acids such as maleic acid, tartaric acid, gluconic acid, glutaric acid, citric acid, lactobionic acid and sucrose mono-, di- and tricarboxylic acids;

amino polycarboxylic acids such as nitrilotriacetic acid, β-alaninediacetic acid, ethylene-diaminetetraacetic acid, serinediacetic acid, iso-serinediacetic acid and alkylethylenediaminetri-acetates;

salts of phosphonic acids such as hydroxyethanediphosphonic acid.

Examples of suitable oligomeric or polymeric carboxylic acids for (E) are:

oligomaleic acids as described, for example, in EP-A 451508 and EP-A 396303;

co- and terpolymers of unsaturated $C_4$–$C_8$-dicarboxylic acids, possible comonomers being monoethylenically unsaturated monomers from group (i) in amounts of up to 95% by weight from group (ii) in amounts of up to 60% by weight and from group (iii) in amounts of up to 20% by weight Examples of suitable $C_4$–$C_8$-dicarboxylic acids in this case are maleic acid, fumaric acid, itaconic acid and citraconic acid. Maleic acid is preferred.

Group (i) comprises monoethylenically unsaturated $C_3$–$C_8$-monocarboxylic acids such as acrylic acid, methacrylic acid, crotonic acid and vinylacetic acid. Acrylic acid and methacrylic acid are preferably used from group (i).

Group (ii) comprises $C_2$–$C_{22}$-monoolefins, vinyl alkyl ethers with $C_1$–$C_8$-alkyl groups, styrene, vinyl esters of $C_1$–$C_8$-carboxylic acids, (meth)acrylamide and vinylpyrrolidone. $C_2$–$C_6$-olefins, vinyl alkyl ethers with $C_1$–$C_4$-alkyl groups, vinyl acetate and vinyl propionate are preferably used from group (ii).

Group (iii) comprises (meth)acrylates of $C_1$–$C_8$-alcohols, (meth)acrylonitrile, (meth) acrylamides of $C_1$–$C_8$-amines, N-vinylformamide and vinylimidazole.

If the polymers of group (ii) contain vinyl esters as copolymerized units, these can also have been partially or completely hydrolyzed to vinyl alcohol structural units. Suitable co- and terpolymers are disclosed, for example, in U.S. Pat. No. 3,887,806 and DE-A 4313909.

Suitable and preferred copolymers of dicarboxylic acids for component (E) are:

copolymers of maleic acid and acrylic acid in the ratio from 100:90 to 95:5, particularly preferably from 30:70 to 90:10, by weight, with molecular weights of from 10,000 to 150,000;

terpolymers of maleic acid, acrylic acid and a vinyl ester of a $C_1$–$C_3$-carboxylic acid in the ratio of from 10 (maleic acid):90 (acrylic acid+vinyl ester) to 95 (maleic acid):10 (acrylic acid+vinyl ester), by weight, it being possible for the ratio of acrylic acid to vinyl ester to vary in the range from 30:70 to 70:30 by weight;

copolymers of maleic acid with $C_2$–$C_8$-olefins in the molar ratio from 40:60 to 80:20, with copolymers of maleic acid with ethylene, propylene or isobutene in the molar ratio 50:50 being particularly preferred.

Graft copolymers of unsaturated carboxylic acids onto low molecular weight carbohydrates or hydrogenated carbohydrates, cf. U.S. Pat. No. 5,227,446, DE-A 4415623 and DE-A 4313909, are likewise suitable as component (E).

Examples of suitable unsaturated carboxylic acids in this case are maleic acid, fumaric acid, itaconic acid, citraconic acid, acrylic acid, methacrylic acid, crotonic acid and vinylacetic acid, and mixtures of acrylic acid and maleic acid, which are grafted in amounts of from 40 to 95% of the weight of the component to be grafted.

For modification, it is additionally possible for up to 30% by weight, based on the component to be grafted, of other monoethylenically unsaturated monomers to be present in the polymer. Suitable modifying monomers are the above-mentioned monomers of groups (ii) and (iii).

Suitable as grafting base are degraded polysaccharides such as starches degraded by acid or enzymatically, inulins or cellulose, protein hydrolysates and reduced (hydrogenated or reductively aminated) degraded polysaccharides such as mannitol, sorbitol, aminosorbitol and N-alkylglucamine, as well as polyalkylene glycols with molecular weights of up to $M_w$=5,000, eg. polyethylene glycols, ethylene oxide/propylene oxide or ethylene oxide/butylene oxide or ethylene oxide/propylene oxide/butylene oxide block copolymers, and alkoxylated mono- or polyhydric $C_1$–$C_{22}$-alcohols, cf. U.S. Pat. No. 5,756,456.

Grafted degraded or degraded reduced starches and grafted polyethylene oxides are preferably used from this group, employing from 20 to 80% by weight of monomers based on the grafting component in the graft copolymerization. A mixture of maleic acid and acrylic acid in the ratio of from 90:10 to 10:90 by weight is preferably used for the grafting.

Polyglyoxylic acids suitable as component (E) are described, for example, in EP-B 001004, U.S. Pat. No. 5399286, DE-A 4106355 and EP-A 0656914. The end groups of the polyglyoxylic acids can have different structures.

Polyamido carboxylic acids and modified polyamido carboxylic acids suitable as component (E) are disclosed, for example, in EP-A 454126, EP-B 511037, WO-A 94/01486 and EP-A 581452.

Also particularly used as component (E) are polyaspartic acids or cocondensates of aspartic acid with other amino acids, $C_4$–$C_{25}$-mono- or -dicarboxylic acids and/or $C_4$–$C_{25}$-mono- or -diamines. Polyaspartic acids prepared in phosphorus-containing acids and modified with $C_6$–$C_{22}$-mono- or -dicarboxylic acids or with $C_6$–$C_{22}$-mono- or -diamines are particularly preferably used.

Condensates of citric acid with hydroxy carboxylic acids or polyhydroxy compounds suitable as component (E) are disclosed, for example, in WO-A 93/22362 and WO-A 92/16493. Such condensates containing carboxyl groups normally have molecular weights of up to 10,000, preferably up to 5,000.

Also suitable as component (E) are ethylenediaminedisuccinic acid, oxydisuccinic acid, amino polycarboxylates, aminopolyalkylenephosphonates and polyglutamates.

It is furthermore possible in addition to components (B) and (E) to use oxidized starches as organic cobuilders.

In another preferred embodiment, the textile detergent formulation according to the invention additionally contains from 0.5 to 30% by weight, in particular 5 to 27% by weight, especially 10 to 23% by weight, of bleaches (F) in the form of percarboxylic acids, eg. diperoxododecanedicarboxylic acid or monoperoxophthalic acid, adducts of hydrogen peroxide onto inorganic salts, eg. sodium perborate monohydrate, sodium perborate tetrahydrate, sodium carbonate perhydrate or sodium phosphate perhydrate, adducts of hydrogen peroxide onto organic compounds, eg. urea perhydrate, or of organic peroxo salts, eg. alkali metal persulfates or peroxodisulfates, where appropriate in combination with from 0 to 15% by weight, preferably 0.1 to 15% by weight, in particular 0.5 to 8% by weight, of bleach activators (G). In the case of color detergents, the bleach (F) is (when present) normally used without bleach activator (G), otherwise bleach activators (G) are usually also present.

Suitable bleach activators (G) are:

polyacylated sugars, eg. pentaacetylglucose;

acyloxybenzenesulfonic acids and their alkali metal and alkaline earth metal salts, eg. sodium p-isononanoyloxybenzenesulfonate or sodium p-benzoyloxybenzenesulfonate;

N,N-diacylated and N,N,N',N'-tetraacylated amines, eg. N,N,N',N'-tetraacetylmethylenediamine and -ethylenediamine (TAED), N,N-diacetylaniline, N,N-diacetyl-p-toluidine or 1,3-diacylated hydantoins such as 1,3-diacetyl-5,5-dimethylhydantoin;

N-alkyl-N-sulfonyl carboxamides, eg. N-methyl-N-mesylacetamide or N-methyl-N-mesylbenzamide;

N-acylated cyclic hydrazides, acylated triazoles or urazoles, eg. monoacetylated maleic hydrazide;

O,N,N-trisubstituted hydroxylamines, eg. O-benzoyl-N,N-succinylhydroxylamine, O-acetyl-N,N-succinylhydroxylamine or O,N,N-triacetylhydroxylamine;

N,N'-diacylsulfamides, eg. N,N'-dimethyl-N,N'-diacetylsulfamide or N,N'-diethyl-N,N'-dipropionylsulfamide;

triacyl cyanurates, eg. triacetyl cyanurate or tribenzoyl cyanurate;

carboxylic anhydrides, eg. benzoic anhydride, m-chlorobenzoic anhydride or phthalic anhydride;

1,3-diacyl-4,5-diacyloxyimidazolines, eg. 1,3-di-acetyl-4,5-diacetoxyimidazoline;

tetraacetylglycoluril and tetrapropionylglycoluril;

diacylated 2,5-diketopiperazines, eg. 1,4-di-acetyl-2,5-diketopiperazine;

products of the acylation of propylenediurea and 2,2-dimethylpropylenediurea, eg. tetracetylpropylenediurea;

α-acyloxypolyacylmalonamides, eg. α-acetoxy-N,N'-diacetylmalonamide;

diacyldioxohexahydro-1,3,5-triazines, eg. 1,5-di-acetyl-2,4-dioxohexahydro-1,3,5-triazine;

benzo-(4 H)1,3-oxazin-4-ones with alkyl radicals, eg. methyl, or aromatic radicals, eg. phenyl, in position 2.

The described bleach system comprising bleaches and bleach activators may also contain bleach catalysts. Examples of suitable bleach catalysts are quaternized imines and sulfone imines which are described, for example, in U.S. Pat. No. 5,360,569 and EP-A 453003. Particularly effective bleach catalysts are manganese complexes which are described, for example, in WO-A 94/21777. When such compounds are used they are incorporated into the detergent formulations in amounts not exceeding 1.5% by weight, in particular up to 0.5% by weight.

Besides the described bleach system comprising bleaches and bleach activators, with or without bleach catalysts, also conceivable for the textile detergent formulation according to the invention is the use of systems with enzymatic liberation of peroxide or of photoactivated bleach systems.

In another preferred embodiment, the textile detergent formulation according to the invention additionally contains from 0.05 to 4% by weight of enzymes (H). Enzymes preferably used in detergents are proteases, amylases, lipases and cellulases. The amounts of enzymes added are preferably 0.1–1.5% by weight, particularly preferably 0.2–1.0% by weight, of the formulated enzyme. Examples of suitable proteases are Savinase and Esperase (manufactured by Novo Nordisk). An example of a suitable lipase is Lipolase (manufactured by Novo Nordisk). An example of a suitable cellulase is Celluzym (manufactured by Novo Nordisk). It is also possible to use peroxidases to activate the bleach system. Single enzymes or a combination of different enzymes can be used. It is possible, where appropriate, for the textile detergent formulation according to the invention also to contain enzyme stabilizers, eg. calcium propionate, sodium formate or boric acids or salts thereof, and/or anti-oxidants.

Besides main components (A) to (H) which have been mentioned, the textile detergent formulation according to the invention may also contain the other conventional additives which follow, in the amounts customary for this purpose:

cationic surfactants, normally in an amount of up to 25% by weight, preferably 3–15% by weight, for example $C_8$–$C_{16}$-alkyldimethylammonium halides or long-chain alkoxydimethylammonium halides;

ampholytic surfactants, normally in an amount of up to 15% by weight, for example derivatives of secondary or tertiary amines, alkyldimethylamine oxides or alkyl- or alkoxymethylamine oxides;

antiredeposition agents and soil release polymers, for example polyesters from polyethylene oxides with ethylene glycol and/or propylene glycol and aromatic and/or aliphatic dicarboxylic acids, polyesters from polyethylene oxides which are capped at one end with dihydric and/or polyhydric alcohols and dicarboxylic acids, amphiphilic graft or other copolymers of vinyl and/or acrylic esters onto polyalkylene oxides or modified celluloses such as methylcellulose, hydroxypropylmethylcellulose or carboxymethylcellulose (CMC);

color transfer inh ibitors, for example homo- and copolymers of vinylpyrrolidone, of vinylimidazole, of vinyloxazolidone or of 4-vinylpyridine N-oxide with molecular weights of from 15,000 to 100,000, and crosslinked fine-particle polymers based on these monomers;

non-surfactant foam reducers or foam inhibitors, for example organopolysiloxanes and mixtures thereof with microfine, possibly silanized silica, and paraffins, waxes, microcrystalline waxes and mixtures thereof with silanized silica;

complexing agents (also acting as organic cobuilders);

optical brighteners;

polyethylene glycols;

perfumes or scents;

bulking agents;

inorganic fillers, eg. sodium sulfate;

formulation aids;

solubility improvers;

opacifying and pearlescent agents;

dyes;

corrosion inhibitors;

peroxide stabilizers;

electrolytes.

The textile detergent formulation according to the invention is solid, ie. is normally in powder or granule form or in pellet or tablet form.

The detergents in powder or granule form according to the invention may contain up to 60% by weight of inorganic fillers. Sodium sulfate is normally used for this purpose. However, the detergents according to the invention preferably contain only up to 20% by weight, particularly preferably only up to 8% by weight, of fillers, especially in the case of compact or ultracompact detergents. The solid detergents according to the invention may have apparent densities varying in the range from 300 to 1,300 g/l, in particular from 550 to 1,200 g/l. Modern compact detergents usually have high apparent densities and display a granular structure. The processes customary in industry can be used for the desired compaction of the detergents.

The textile detergent formulation according to the invention is produced and, where appropriate, packed by conventional methods.

The use of glycine-N,N-diacetic acid derivatives I as component (B) makes it possible to reduce the amount of insoluble ingredient in the builder system consisting of one or more inorganic builders and one or more organic cobuilders, and thus to improve the solubility of the complete builder system, and therefore also of the detergent, while the use properties (single wash and multi wash cycle performance) are maintained or even improved.

Typical compositions of compact heavy duty detergents and color detergents are indicated below (the percentage data below and in the examples are based on weight; the data in parentheses in compositions (a) and (b) are preferred ranges):

(a) Composition of compact heavy duty detergent (powder or granule form)

| | |
|---|---|
| 1–60% (8–30%) | at least one anionic (C) and one nonionic surfactant (D) |
| 5–50% (10–45%) | at least one inorganic builder (A) |
| 0.1–20% (0.5–15%) | at least one organic cobuilder (B) with or without (E) |
| 5–30% (10–25%) | an inorganic bleach (F) |
| 0.1–15% (1–8%) | a bleach activator (G) |
| 0–1% (max. 0.5%) | a bleach catalyst |
| 0.05–5% (0.2–2.5%) | a color transfer inhibitor |
| 0.3–1.5% | a soil release polymer |
| 0.1–4% (0.2–2%) | an enzyme or enzyme mixture (H) |

Further conventional additives:

sodium sulfate, complexing agents, phosphonates, optical brighteners, perfume oils, foam reducers, antiredeposition agents, bleach stabilizers (b) Composition of color detergent (powder or granule form)

| | |
|---|---|
| 3–50% (8–30%) | at least one anionic (C) and one nonionic surfactant (D) |
| 10–60% (20–55%) | at least one inorganic builder (A) |
| 0–15% (0–5%) | an inorganic bleach (F) |
| 0.05%–5% (0.2–2.5%) | a color transfer inhibitor |
| 0.1–20% (1–8%) | at least one organic cobuilder (B) with or without (E) |
| 0.2%–2% | an enzyme or enzyme mixture (H) |
| 0.2–1.5% | a soil release polymer |

Further conventional additives:

sodium sulfate, complexing agents, phosphonates, optical brighteners, perfume oils, foam reducers, antiredeposition agents, bleach stabilizers.

EXAMPLES

Table 2 is a compilation of examples of compositions of modern compact detergent formulations A to M. The results of use tests relate to textile detergent formulations A to C in Table 2.

Detergent formulations A, B and C were used to test the use properties. Formulations B and C contained the organic cobuilder α-D,L-alanine-N,N-diacetic acid (methylglycine-N,N-diacetic acid, MGDA) according to the invention. Formulations B and C, similar to B and C but containing no organic cobuilder, were prepared for comparison.

Washing tests were carried out with these formulations, and both the single wash cycle performance and the incrustation inhibition were determined.

Washing conditions for single wash cycle performance
Machine: Launder-o-meter from Atlas, Chicago, USA
Wash liquor: 250 ml
Washing time: 30 min at 60° C.
Detergent dose: 4.5 g/l
Water hardness: 3 mmol Ca:Mg 3:1
Liquor ratio: 1:12.5
Test fabric: WFK lOD, WFK 20D (WFK-Testgewebe GmbH, D-41379 Brüggen-Bracht) EMPA 101, EPMA 104 (Eidgenössische Materialpruifanstalt, St. Gallen, Switzerland)

The washed test fabrics were measured using a Datacolor photometer (Elrepho® 2000). In each case the totals of the average reflectances obtained by multiple measurement on the individual test fabric are indicated.

Washing conditions for incrustation
Machine: Launder-o-meter from Atlas, Chicago, USA
Wash liquor: 250 ml
Washing time: 30 min at 60° C.
Wash cycles: 15
Detergent dose: 4.5 g/l
Water hardness: 4 mmol Ca:Mg 4:1
Liquor ratio: 1:12.5
Test fabric: cotton cheesecloth The detergent formulations described in the table were each used for washing cotton test fabric. The number of wash cycles was 15. After this number of washes, the ash content of the fabric was determined by ashing at 700° C. in each case.

TABLE 1

Washing results

| Example No. | Formulation | Zeolite A as builder in [%] | $Na_2CO_3$ as builder in [%] | MGDA as cobuilder in [%] | Ash [%] | Single wash cycle performance Total reflectance in [%] |
|---|---|---|---|---|---|---|
| 1 | B | 28.5 | 9.5 | 5 | 1.84 | 189.7 |
| 2 | C | 24 | 8 | 8 | 1.86 | 206.1 |
| C1 | A | 36 | 12 | — | 2.86 | 178.7 |
| C2 | B | 28.5 | 9.5 | — | 3.15 | 176.1 |
| C3 | C | 24 | 8 | — | 3.80 | 166.7 |

It is evident from Examples C1, C2 and C3 that reducing the builder content by 10 to 16% leads to a marked increase in incrustation and a simultaneous deterioration in the single wash cycle performance of the formulation. When half the reduced builder content is replaced by the cobuilder MGDA according to the invention (by 5% MGDA in Example 1 and by 8% MGDA in Example 2) there is a marked improvement in the incrustation inhibition and the single wash cycle performance to be, in fact, superior to comparative detergent A (C1) which is formulated with the complete builder system.

The cobuilder according to the invention thus makes it possible to reduce the insolubles contents of detergent formulations with, at the same time, improvements in the single wash cycle performance and the incrustation inhibition being obtained.

TABLE 2

Detergent formulations

| | Composition [%] | | | | | | | | | | | | |
|---|---|---|---|---|---|---|---|---|---|---|---|---|---|
| Ingredients | A | B | C | D | E | F | G | H | I | J | K | L | M |
| Linear $C_{12}$-alkylbenzenesulfonate (sodium salt) | 8 | 8 | 8 | | | | | | | | | | |
| $C_{12}$–$C_{18}$-alkyl sulfate | | | | 10 | 10 | 10 | 10 | 10 | 10 | 10 | 8 | 8 | 8 |
| $C_{12}$-fatty alcohol × 2 EO sulfate | | | | | | | | | | | 2 | 2 | 2 |
| $C_{12}$–$C_{18}$-fatty alcohol × 4 EO | | | | | | | | | | | 3 | 3 | 3 |
| $C_{12}$–$C_{18}$-fatty alcohol × 7 EO | | | | 7 | 7 | 7 | 7 | | | | | 4 | 4 |
| $C_{13}$–$C_{15}$-oxo alcohol × 7 EO | 7 | 7 | 7 | | | | | | | | | | |
| $C_{16}$–$C_{18}$-glucamide | | | | | | | | | | | 4 | | |
| $C_{12}$-$C_{14}$-alkyl polyglucoside | | | | | | | | 9 | | | | | |
| $C_8$–$C_{18}$-fatty acid methyltetraglycol amide | | | | | | | | | 9 | | | | |
| Oleoylsarcosinate | | | | | | | | | | 9 | | | |

TABLE 2-continued

| Ingredients | Detergent formulations Composition [%] A | B | C | D | E | F | G | H | I | J | K | L | M |
|---|---|---|---|---|---|---|---|---|---|---|---|---|---|
| Soap (conventional fatty acid sodium salt) | 2 | 2 | 2 | 1 | 1 | 1 | 1 | 1 | 1 | 1 | 2 | 2 | 2 |
| Na metasilicate × 5.5 H2O | | | | 3 | 3 | 3 | 3 | 3 | 3 | 3 | | | |
| Zeolite A | 36 | 28.5 | 24 | 30 | 20 | 10 | 10 | 30 | 30 | 30 | 20 | 15 | 20 |
| Zeolite P | | | | | | | 10 | | | | | | |
| Sheet silicate SKS 6 | | | | | | | | | | | 15 | 15 | 15 |
| Amorphous sodium disilicate | | | | | | | | | | | | | |
| Sodium carbonate | 12 | 9.5 | 8 | 10 | 10 | 10 | 10 | 8 | 8 | 8 | | | 10 |
| Sodium citrate | | | | | | | | | | | 5 | 5 | |
| MGDA (as trisodium salt) | | 5 | 5 | 5 | 5 | 5 | 5 | 5 | 5 | 5 | 5 | 5 | 5 |
| TAED | 2 | 2 | 2 | 5 | 5 | 5 | 5 | 4 | 4 | 4 | 5 | 5 | 5 |
| Sodium perborate × 4 H2O | 22 | 22 | 22 | | | | | | | | | | |
| Sodium perborate × 1 H2O | | | | | | | | 14.4 | 14.4 | 14.4 | | | |
| Sodium percarbonate | | | | 15 | 15 | 15 | 15 | | | | 15 | 15 | 15 |
| Carboxymethylcellulose | 1 | 1 | 1 | 1 | 1 | 1 | 1 | 1.2 | 1.2 | 1.2 | 1 | 1 | 1 |
| Lipase | 0.2 | 0.2 | 0.2 | 0.2 | 0.2 | 0.2 | 0.2 | 0.2 | 0.2 | 0.2 | 0.2 | 0.2 | 0.2 |
| Protease | 0.3 | 0.3 | 0.3 | 0.3 | 0.3 | 0.3 | 0.3 | 0.3 | 0.3 | 0.3 | 0.3 | 0.3 | 0.3 |
| Cellulase | 0.5 | 0.5 | 0.5 | 0.5 | 0.5 | 0.5 | 0.5 | 0.5 | 0.5 | 0.5 | 0.5 | 0.5 | 0.5 |
| Sodium sulfate | 2 | 2 | 2 | 3 | 3 | 3 | 3 | 3 | 3 | 3 | 3 | 3 | 3 |
| Polymer (AA/MA copolymer MW 70,000) | 5 | 5 | 8 | 5 | 5 | 5 | 5 | 5 | 5 | 5 | 4 | 4 | 4 |
| Conventional phosphonate | | | | | | | | | | | 0.5 | 0.5 | 0.5 |
| Conventional soil release polymer | | | | 0.5 | 0.5 | 0.5 | 0.5 | 0.5 | 0.5 | 0.5 | 0.5 | 0.5 | 0.5 |
| Conventional color transfer inhibitor | | | | 0.2 | 0.2 | 0.2 | 0.2 | 0.2 | 0.2 | 0.2 | 0.5 | 0.5 | 0.5 |
| Water | 2 | 7 | 10 | 3.3 | 13.3 | 23.3 | 13.3 | 4.7 | 4.7 | 4.7 | 5.5 | 10.5 | 0.5 |

We claim:

1. A solid textile detergent formulation, comprising (A) 10–32% by weight of inorganic builders aluminosilicates and alkali metal carbonates in the ratio of 98:2 to 20:80 by weight, (B) 0.1–15% by weight of one or more glycine-N,N-diacetic acid derivatives of the general formula I (I)

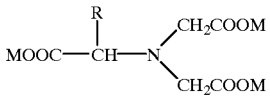

where

R is $C_1$–$C_{30}$-alkyl or $C_2$–$C_{30}$-alkenyl, each of which may additionally carry as substituents up to 5 hydroxyl groups, formyl groups, $C_1$–$C_4$-alkoxy groups, phenoxy groups or $C_1$–$C_4$-alkoxycarbonyl groups and be interrupted by up to 5 non-adjacent oxygen atoms, or alkoxylate groups of the formula $—(CH_2)_k\text{-}O\text{-}(A^2O)_m—(A^2O)_m—(A^2O)_n—Y$, where $A^1$ and $A^2$ are, independently of one another, 1,2-alkylene groups having 2 to 4 carbon atoms, Y is hydrogen, $C_1$–$C_{12}$-alkyl, phenyl or $C_1$–$C_4$-alkoxycarbonyl, and k is 1, 2 or 3, and m and n are each from 0 to 50, where the total of m+n must be at least 4, or phenylalkyl groups having from 1 to 20 carbon atoms in the alkyl, a five- or six-membered unsaturated or saturated heterocyclic ring which has up to three heteroatoms from the group consisting of nitrogen, oxygen and sulfir and which can additionally be benzo-fused, it being possible for all the phenyl nuclei and heterocyclic rings mentioned in the meanings of R additionally to carry as substituents up to three $C_1$–$C_4$-alkyl groups, hydroxyl groups, carboxyl groups sulfo groups or $C_1$–$C_4$-alkoxycarbonyl groups, or a radical of the formula

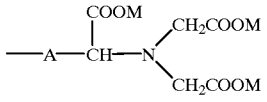

where A is a $C_1$–$C_{12}$-alkylene bridge or a chemical bond, and

M is hydrogen, alkali metal, alkaline earth metal, ammonium or substituted ammonium in the appropriate stoichiometric amounts, as organic cobuilders, (C) 1–40% by weight of anionic surfactants and (D) 0.5–30% by weight of nonionic surfactants. and 0.05–4% by weight of enzymes.

2. A solid textile detergent formulation as claimed in claim 1, additionally comprising (E) 0.5–20% by weight of other organic cobuilders in the form of low molecular weight, oligomeric or polymeric carboxylic acids or phosphonic acids or salts thereof.

3. A solid textile detergent formulation as claimed in claim 1, additionally comprising (F) 0.5–30% by weight of bleaches in the form of percarboxylic acids, adducts of hydrogen peroxide onto inorganic salts or organic compounds or of inorganic peroxo salts and, where appropriate, (G) 0.1–15% by weight of bleach activators.

4. A solid textile detergent formulation as claimed in claim 1, comprising as an inorganic builder component (A) a mixture of zeolite A and sodium carbonate in the ratio from 85:15 to 40:60 by weight.

5. A solid textile detergent formulation as claimed in claim 1, comprising as glycine-N,N-diacetic acid derivatives I for (B) those where R is $C_1$–$C_{20}$-alkyl, $C_2$–$C_{20}$-alkenyl or a radical of the formula

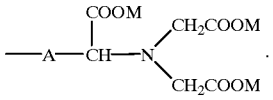
6. A solid textile detergent formulation as claimed in claim 1, where the ratio of components (C) and (D) is from 95:5 to 20:80 by weight.
7. A solid textile detergent formulation as claimed in claim 1 with an apparent density of from 300 to 1,300 g/l.
* * * * *